US006144267A

United States Patent [19]

Saitoh et al.

[11] Patent Number: 6,144,267

[45] Date of Patent: Nov. 7, 2000

[54] NON-RADIATIVE DIELECTRIC LINE ASSEMBLY

[75] Inventors: Atsushi Saitoh, Muko; Toru Tanizaki, Kyoto; Hiroshi Nishida, Kawanishi; Ikuo Takakuwa, Suita; Yoshinori Taguchi, Nagaokakyo, all of Japan

[73] Assignee: Murata Manufacturing Co., Ltd., Japan

[21] Appl. No.: 09/216,109

[22] Filed: Dec. 18, 1998

[30] Foreign Application Priority Data

Dec. 25, 1997 [JP] Japan ..... 9-357373

[51] Int. Cl.[7] ..... H01P 5/02; H01P 1/10

[52] U.S. Cl. ..... 333/34; 333/1.1; 333/113; 333/248; 333/258; 333/254; 455/326

[58] Field of Search ..... 333/1.1, 113, 219.1, 333/239, 248, 258, 101, 108, 34, 284; 455/325, 326, 328

[56] References Cited

U.S. PATENT DOCUMENTS

| | | | |
|---|---|---|---|
| 5,473,296 | 12/1995 | Ishikawa et al. | 333/239 |
| 5,776,989 | 6/1998 | Ishikawa et al. | 333/248 |
| 5,987,315 | 11/1999 | Nishida | 333/248 X |
| 6,008,755 | 12/1999 | Ishikawa et al. | 333/219.1 X |

FOREIGN PATENT DOCUMENTS 0767507 4/1997 European Pat. Off. .

OTHER PUBLICATIONS

Tsukasa Yoneyama: "Millimeter–Wave Integrated Circuits Using Nonradiative Dielectric Waveguide" Electronics & Communications in Japan, Part II—Electronics, vol. 74, No. 2, 1 Feb. 1991, pp. 20–28, p. 20, right–hand column, line 9, line 22, p. 21, right–hand column, line 14–line 27, figures 1, 8, 13.

Xiao L–L et al.: "Analysis of Groove NRD Waveguide Bend Using The Coupled–Mode Theory" International Journal of Infrared and Millimeter Waves, vol. 13, No. 7, Jul. 1992, pp. 971–980, p. 971, line 10–line 24.

European Search Report dated April 8, 1999.

*Primary Examiner*—Paul Gensler

*Attorney, Agent, or Firm*—Ostrolenk, Faber, Gerb & Soffen, LLP

[57] ABSTRACT

A normal NRD guide is constituted in the part to be coupled with a dielectric resonator, a hyper NRD guide for simply transmitting the LSM01 mode is constituted in a multipoints circulator part, the normal NRD guide is constituted in a coupler part, the hyper NRD guide is constituted in the mixer part, and the normal NRD guides are constituted in a dielectric line switch part and in a connection unit between components.

4 Claims, 12 Drawing Sheets

A TOP VIEW OF THE INTERNAL STRUCTURE OF THE TRANSFORMATION UNIT

A TOP VIEW OF THE INTERNAL STRUCTURE OF THE TRANSFORMATION UNIT

A-A' CROSS-SECTIONAL VIEW (A CROSS-SECTIONAL VIEW OF THE FIRST TRANSFORMATION UNIT)

B-B' CROSS-SECTIONAL VIEW (A CROSS-SECTIONAL VIEW OF THE SECOND TRANSFORMATION UNIT)

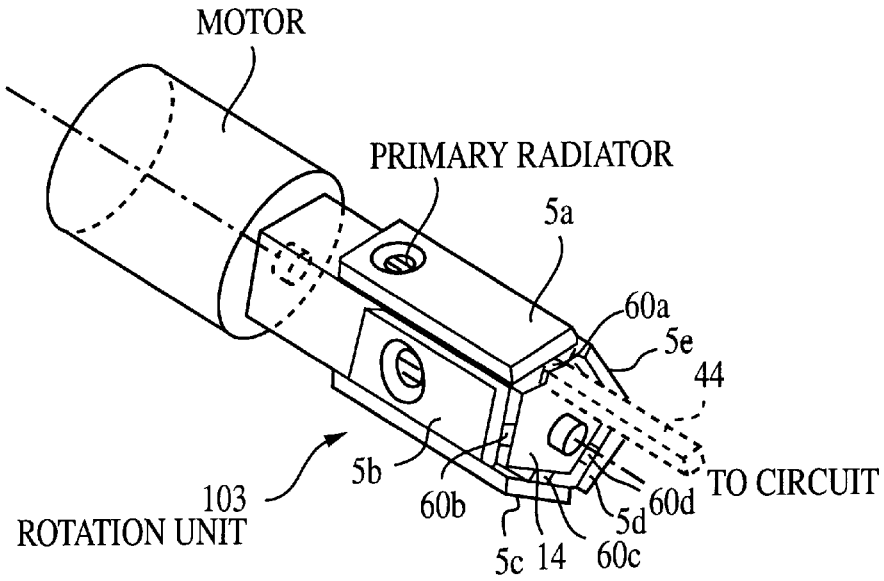
FIG. 10
FIG. 11A
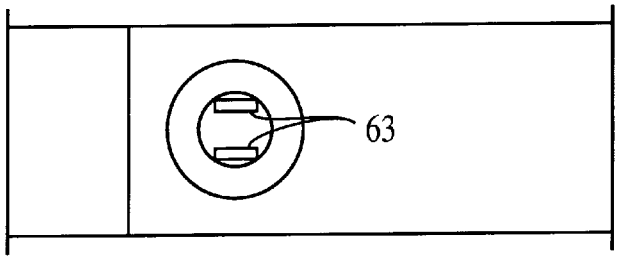
FIG. 11B
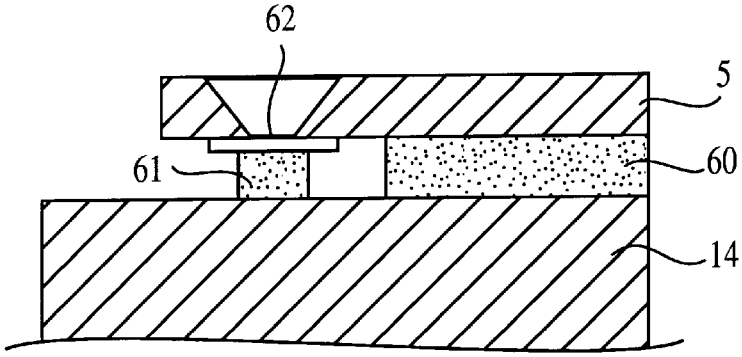

ELECTRIC FIELD ENERGY DISTRIBUTION IN THE O-A PART OF NORMAL NRD•G

ELECTRIC FIELD ENERGY DISTRIBUTION IN THE O-A PART OF HYPER NRD•G

NON-RADIATIVE DIELECTRIC LINE ASSEMBLY

BACKGROUND OF THE INVENTION

1. Field of the Invention

The present invention relates to an electronic part. More particularly, the present invention relates to an electronic part having a non radiative dielectric waveguide and integrated circuit using the same which are used in a microwave or millimeter-wave radar for example.

2. Description of the Related Art

As shown in FIG. 2, a conventional transmission line for a millimeter wave or a micrometer wave, has two parallely opposing conductive plates 1, 2 and a dielectric strip 3 disposed between the conductive plates. A normal type non radiative dielectric waveguide ("normal NRD") is a kind of transmission line. The distance a2 between the conductive plates is adjusted to be equal to or less than a half wavelength of a wavelength of an electromagnetic wave so that the electromagnetic wave propagates only in the strip line 3.

A millimeter wave module that uses tie NRD guide is constituted by integrating each of the components, such as an oscillator, a mixer, and a coupler, but originally, the normal NRD guide has been used as the NRD guide of each component.

On one hand, in the normal NRD guide as mentioned above, there has been a problem such that since a transmission loss is occurred by a mode transformation of the LSM01 mode and the LSE01 mode in a bend part, it makes it impossible to design a bend having an arbitrary radius of curvature, and for preventing the transmission loss by the above mentioned mode transformation, the radius of curvature in the bend part can rot be made smaller, thereby the module as a whole can not be miniaturized. Accordingly, as shown in FIG. 1, it has been developed a NRD guide (hereinafter, it refers to as a hyper NRD guide) that is configured to form the respective grooves in the facing planes of the conductive plates 1, 2, and to place a dielectric strip 3 between the grooves, thereby transmitting a single mode of the LSM01, and it is disclosed in laid-open Japanese Patent Application No. 9-102706.

It makes possible to design a bend with a little transmission loss and having an arbitrary radius of curvature according to the above mentioned hyper NRD guide, thereby resulting in an advantage of miniaturizing the module as a whole. However, in general, the transmission loss is less in the normal NRD guide if not considering the transmission loss with the above mentioned mode transformation in the bend part.

Further, when constituting a single millimeter wave module by combining the above mentioned components, a positional displacement is inevitably occurred in either a propagation direction of tie electromagnetic wave or a direction perpendicular to the propagation direction of the electromagnetic wave, at the connection plane of the conductive plate and the dielectric strip, according to a dimensional accuracy for each of the respective components and an assemble accuracy of the respective components, and also an amount of that positional display varies. In a normal NRD guide, the reflection loss is lower at the connecting portion in comparison with a hyper NRD guide. Similarly, transmittivity of electromagnetic wave is high at the connecting portion.

Also, in the coupler for example, an excellent characteristics may be obtained without requiring a high dimensional accuracy since using the normal NRD guides as two NRD guides placed with a predetermined space the electric field energy distribution spreads wider than tie case of using the hyper NRD guide.

Further, when constituting an oscillator by coupling the dielectric resonator with the non radiative dielectric line, in general, the normal NRD guide is more appropriate since the normal NRD guide can easily and strongly couple the dielectric resonator and the non radiative dielectric line.

SUMMARY OF THE INVENTION

It is an object of the present invention to provide a non radiative dielectric line part that is miniaturized as a whole and having excellent characteristic, with utilizing the respective characteristics of the normal NRD guide and the hyper NRD guide.

The object of the present invention can be achieved by a non radiative dielectric line part, providing a dielectric strip between two conductive planes in approximately parallel, using a non radiative dielectric line with an area of the dielectric strip as a propagation area of an electromagnetic wave and with an area other than the area of the dielectric strip as a non-propagation area, including a first type of non radiative dielectric line in which a space between the conductive planes is made to be approximately equal to a height of the dielectric strip; and a second type of non radiative dielectric line in which the space between the conductive planes in the non-propagation area is made smaller than a space of the conductive planes in the propagation area, in which a cut-off frequency of a LSM01 mode that propagates in the propagation area is lower than a cut-off frequency of a LSE01 mode, and in which only LSM01 mode propagates with a usage frequency.

Preferably, the first type of non radiative dielectric line is provided in a part that couples to a dielectric resonator.

More preferably, the second type of non radiative dielectric line is used for a transmission line of a multipointed circulator.

Further it is preferable that, by drawing said first type of non radiative dielectric lines closer, a coupler that couples them each other is formed.

It is preferable that by placing two of said second type of non radiative dielectric lines in alignment with an approximately at right angle, a mixer is formed.

The non radiative dielectric line switch that switches a propagation/non propagation of an electromagnetic wave on a line by varying a facing alignment of two of said first type of non radiative dielectric lines, is provided, preferably.

Preferably, the first type of non radiative dielectric line is provided in a connection part with neighboring other non radiative dielectric line part.

It is another object of the present invention to provide an integrated circuit of a non radiative dielectric line part having an excellent characteristic, with utilizing the respective characteristics of the normal NRD guide and the hyper NRD guide.

Another object of the present invention can be achieved by the non radiative dielectric line integrated circuit that is constituted by combining the non radiative dielectric line parts.

BRIEF DESCRIPTION OF THE DRAWINGS

FIG. 10 is a perspective view showing a configuration of a rotational unit;

FIGS. 11A and 11B are views showing a configuration of a primary radiator part;

DETAILED DESCRIPTION OF EMBODIMENTS OF THE INVENTION

Referring to FIGS. 1 to 13, a configuration of a millimeter radar module that is an embodiment of the present invention will be described in detail.

Figure 1:
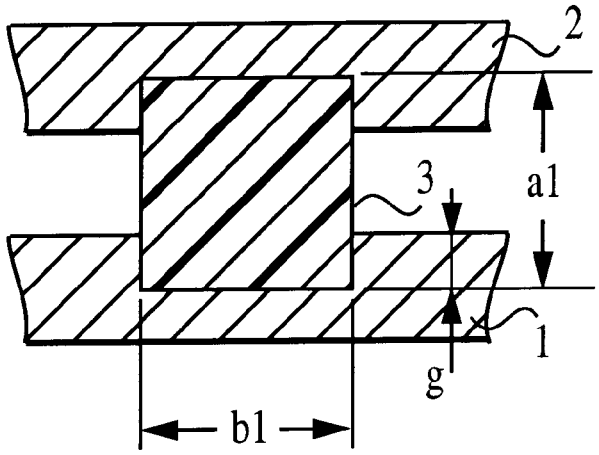
FIG. 1 PRIOR ART
FIG. 1 is a view showing a cross-sectional structure of the hyper NRD guide in an embodiment.
Figure 2:
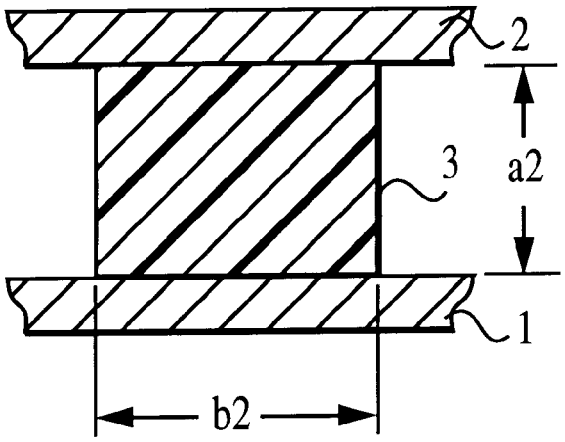
FIG. 2 PRIOR ART
FIG. 2 is a view showing a cross-sectional structure the normal NRD guide in the same.

As already described above, FIG. 1 is a cross-sectional view of the hyper NRD guide part, FIG. 2 is a cross-sectional view of the normal NRD guide part. In either NRD guide, a dielectric strip 3 is placed between two conductor plates 1, 2 of the upper and lower. In the normal NRD guide shown in FIG. 2, the height dimension a2 of the dielectric strip 3 is equal to a space between the conductor plates 1, 2, but in the hyper NRD guide shown in FIG. 1, a groove with a depth g is respectively formed in the conductor plates 1, 2, so that a space between the conductor plates 1, 2 in the area where there is no dielectric strip 3 is made shorter than the height dimension a1 of the dielectric strip 3, thereby the area where there is the dielectric strip is set to be a propagation area where a single mode of the LSM01 propagates.

Figure 3A:
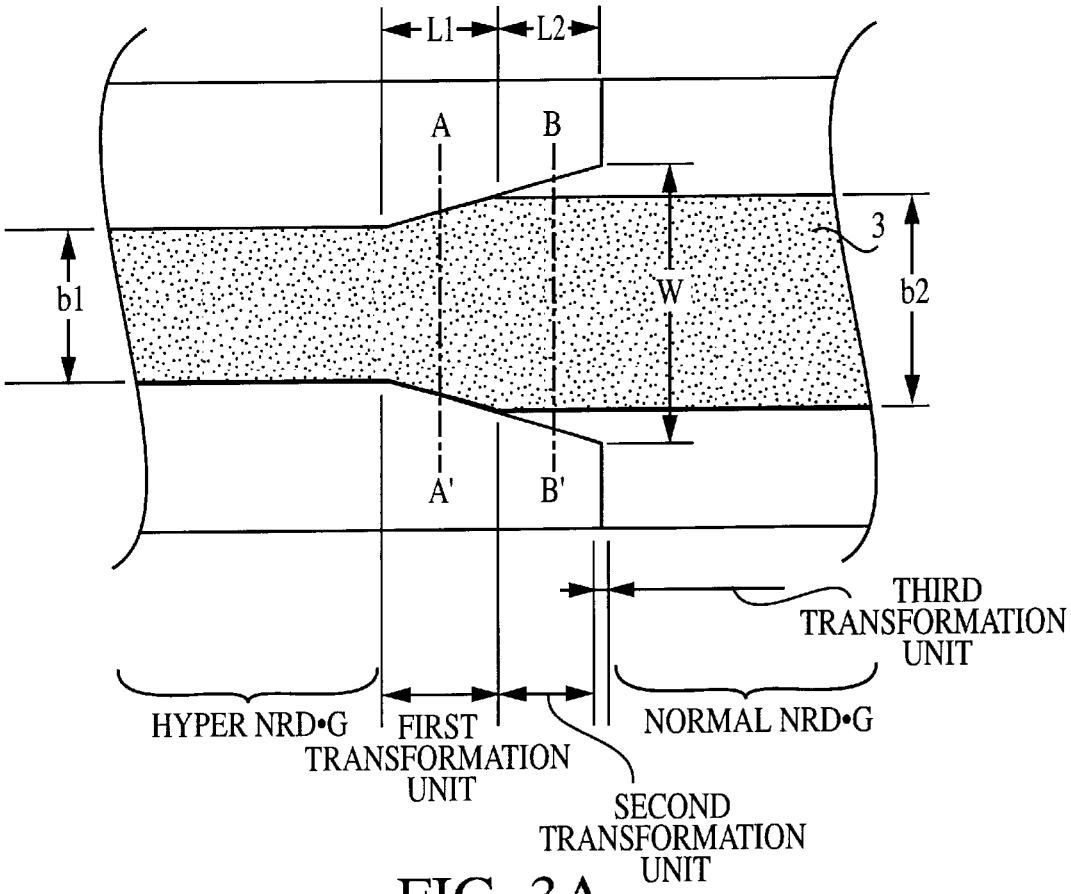
FIGS. 3A to 3C are views showing a structure of the line transforming part of the hyper NRD guide and the normal NRD guide.
Figure 3B:
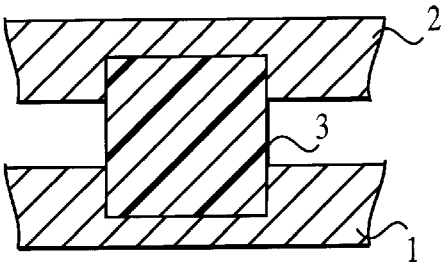
Figure 3C:
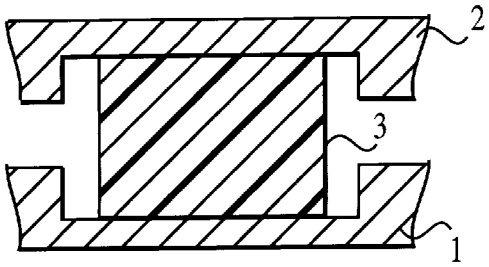

FIGS. 3A to 3C are views showing a structure of the line transformation unit of the normal NRD guide and the hyper NRD guide, and FIG. 3A is a plane view in a state that the upper conductor plate is removed, FIG. 3B is a cross-sectional view of the A–A' part in FIG. 3A, and FIG. 3C is a cross-sectional view of the B–B' part in FIG. 3A. As shown in the figures, in the middle part of the hyper NRD guide and the normal NRD guide, the first transformation unit varies the width b1 of the dielectric strip 3 in the hyper NRD guide part up to the width b2 in the normal NRD guide, over the distance L1. In association with varying a width of a dielectric strip to a taper form, the widths of the grooves provided in the upper and lower conductor plates 1, 2 are also varied from b1 to b2 over this distance L1. In the second transformation unit, it has a groove in the same depth as the groove in the hyper NRD guide part, and a width of that groove is made in a shape as being spread in a taper form (or a horn form) continuously over a distance L2 from the first transformation unit, and it is spread to W in the third transformation unit. Further, in this second transformation unit, the dielectric strip 3 has the same width b2 as the dielectric strip in the normal NRD guide part. In the third transformation unit, the widths of the grooves in the upper and lower conductor plates 1, 2 are configured to be spread in the plane directions which are approximately perpendicular to the propagation directions of the electromagnetic waves and that of the conductor plates 1, 2.

With the structure as described above, by defining the length L2 of the second transformation unit in such a manner that a reflected wave in the first transformation unit and a reflected wave in the third transformation unit are combined in the reversed phase, a different kind of a non radiative dielectric line transformation unit structure with a low reflection in a predetermined frequency band can be obtained.

Figure 4:
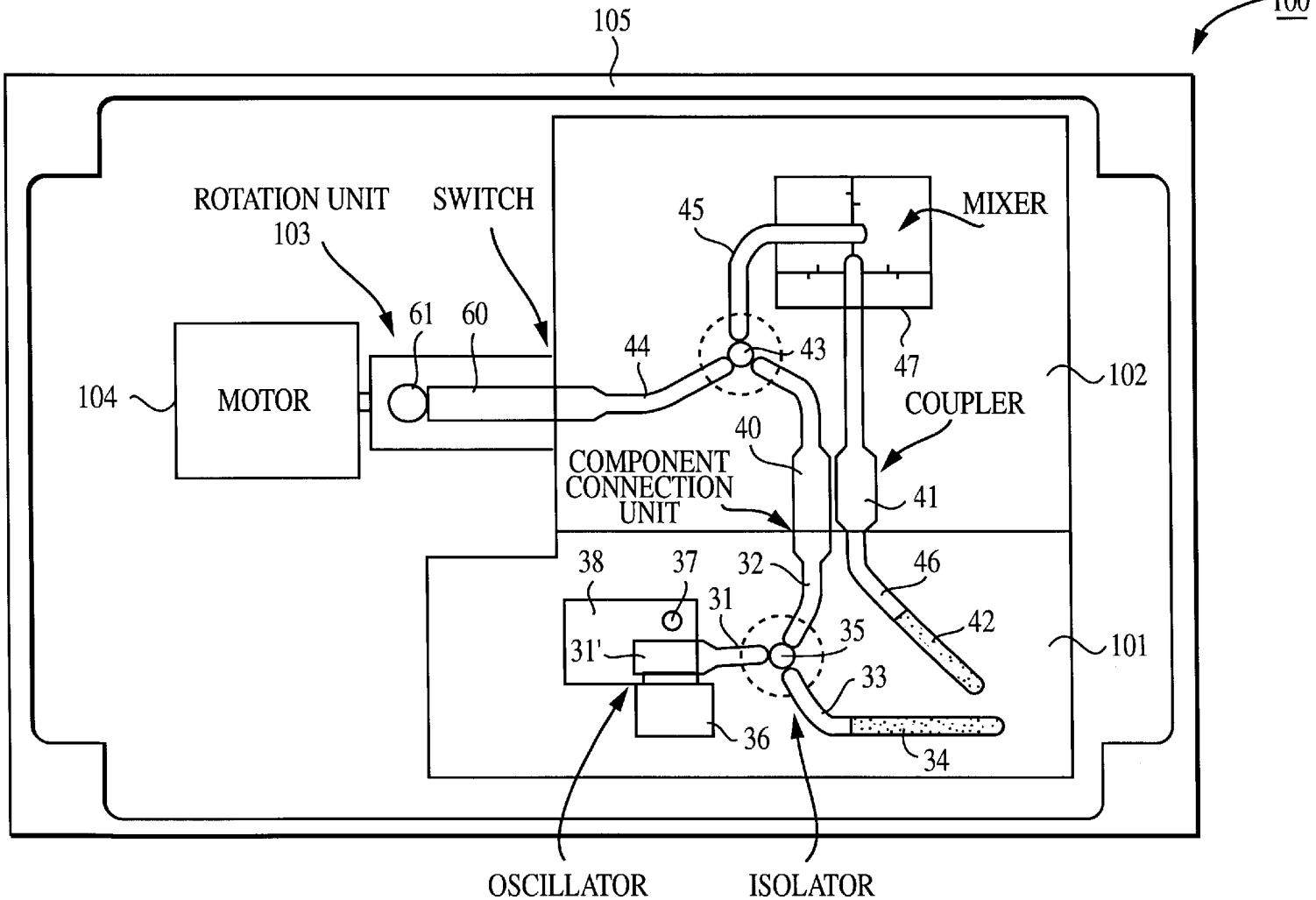
FIG. 4 is a view showing a configuration of a millimeter wave radar module.

FIG. 4 is a view showing a state in which the dielectric lens part in an upper plane (a plane that implements of transmitting and receiving a millimeter wave) of a millimeter wave radar module is removed, and the upper conductor plate is also removed. This millimeter radar module is constituted of the components 101, 102, a rotation unit 103, a motor 104, a casing 105 which accommodates them, and a dielectric lens as not being shown, etc. In the component 101 an oscillator, an isolator and a terminator are provided. In the component 102, a coupler, circulator and a mixer are provided.

Figure 5:
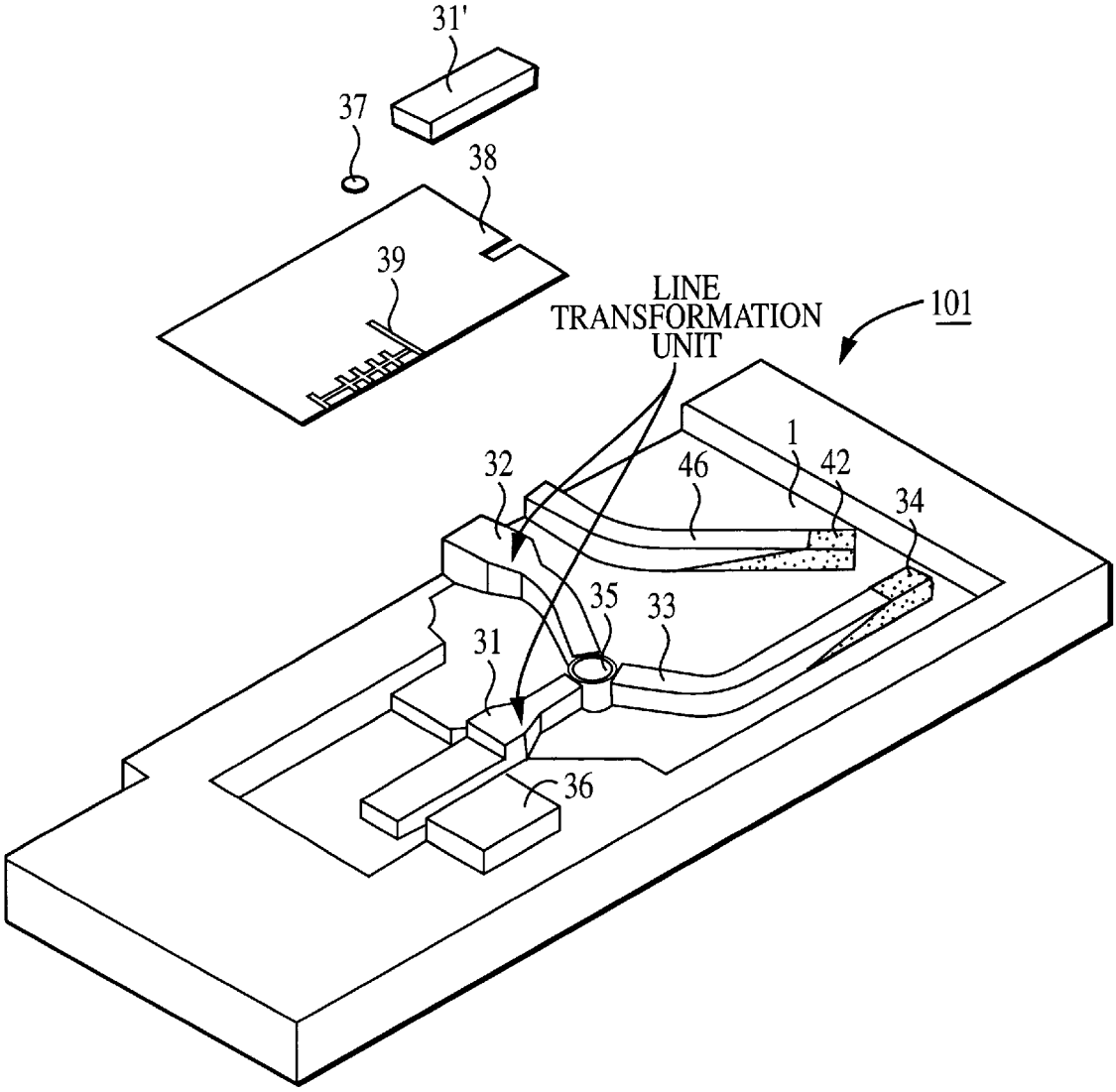
FIG. 5 is an exploded perspective view of the components including an oscillator and an isolator.

FIG. 5 is an exploded perspective view showing a configuration of the above mentioned component 101. In the FIG. 1 indicates the lower conductor plate, and even though they are omitted in the figure, the dielectric strips 31, 32, 33, 46 are placed between the upper conductor plate. 38 indicates a dielectric plate, and various kinds of conductor patterns such as an excitation probe 39 and the like on a surface thereof. This dielectric substrate 38 is placed as sandwiching it between the dielectric strips 31 and 31'. Further, 37 indicates a dielectric resonator, and is placed at where it couples with the predetermined parts of the dielectric strips 31' and 31. 36 indicates a Gunn diode block, and connects one of the electrodes in the Gunn diode to the excitation probe 39 on the dielectric substrate 38. 35 indicates a ferrite resonator, and a circulator is constituted of this ferrite resonator, three dielectric strips, and a magnet as not being shown. Further, the terminator 34 is provided at the end part of the dielectric strip 33, so as to configure an isolator as a whole. When configuring an oscillator using the dielectric resonator as described above, by letting the NRD guide in the part that couples to the dielectric resonator 37 to be as the normal NRD guide, enabling to make the coupling of them much stronger. Further, the dielectric strip 46 is the one to be connected to one of the dielectric strips that constitute the coupler of the component 102, and the terminator 42 is provided at the end part thereof.

Figure 16A:
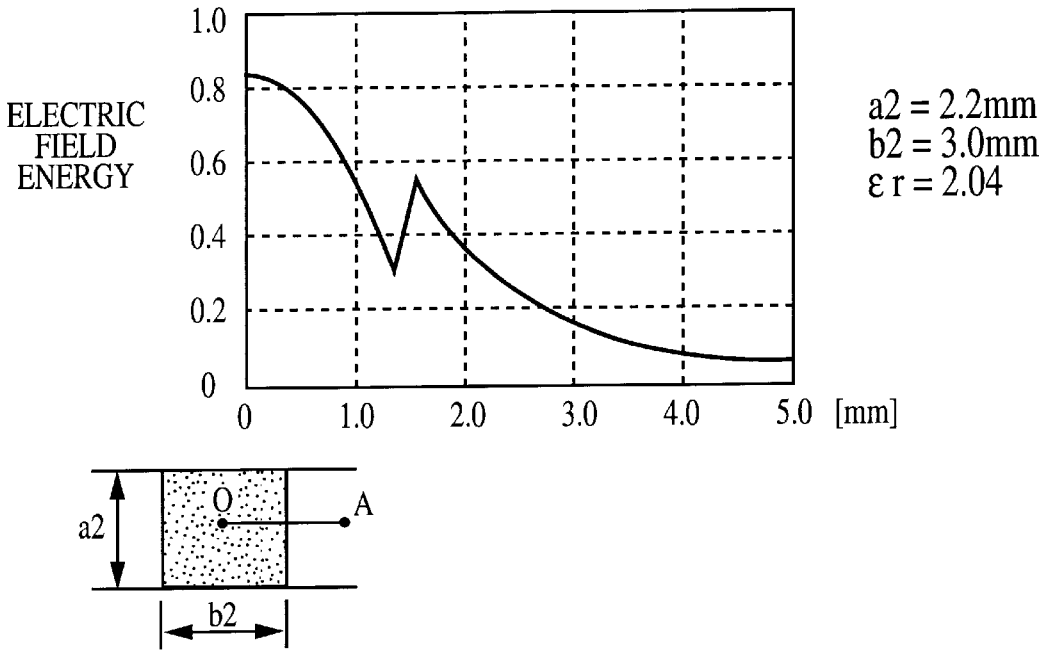
FIG. 16A and 16B are diagrams showing the examples of electric field energy distributions in the normal NRD guide and in the hyper NRD guide.
Figure 16B:
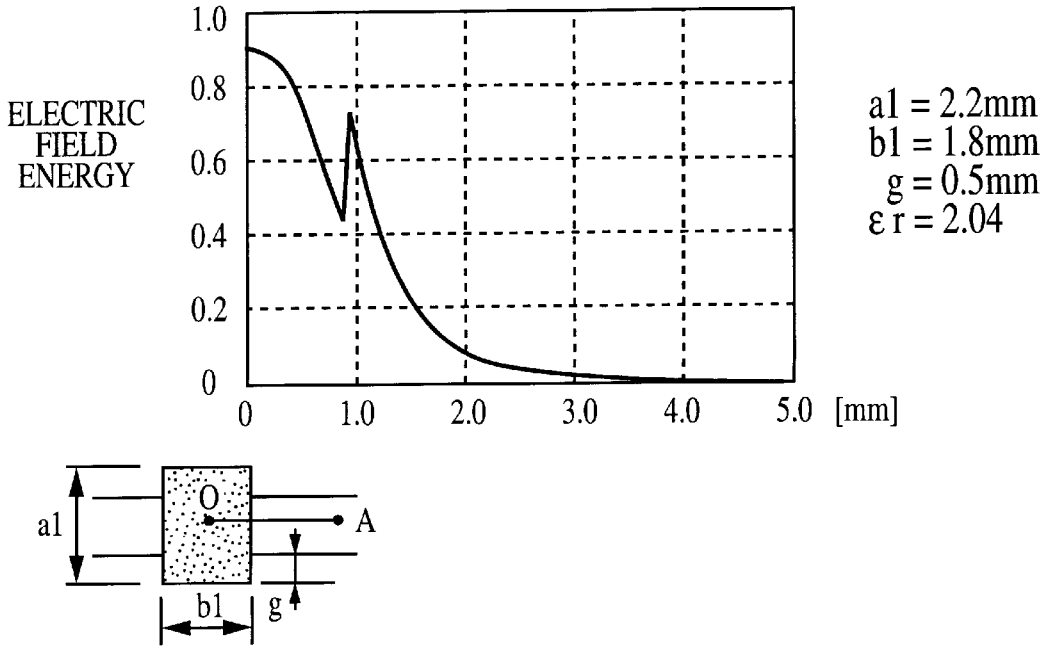

Here, the electric field energy distribution that spread in the transverse direction of the line cross-section from the center of the dielectric strip, for the normal NRD guide and for the hyper NRD guide is shown in FIGS. 16A and 16B.

As apparent from comparing them, much stronger coupling can be obtained in the normal NRD guide comparing with the hyper NRD guide when placing the dielectric strips as being spaced with the same distance, and thus a variation of the coupling strength for a variation of the distance becomes smooth, thereby the required dimensional accuracy of the relative alignment between the dielectric resonator 37 and the dielectric strips 31, 31' shown in FIG. 5 becomes lower.

In FIG. 5 the circular part sets, in order to avoid a problem caused by the mode transformation to the LSE01, and also since it is necessary to provide a bend, the dielectric line thereof to be as the hyper NRD guide. Further, in the neighboring parts to this component 101 the above mentioned component 102 is placed, and the dielectric strip 32 implements a connection of the line as facing to the dielectric strip of the component 102 thereof. Accordingly, this part is to be as a configuration of the normal NRD guide. As shown in the figure, the line transformation units of the normal NRD guide and the hyper NRD guide are provided in these two parts.

Figure 6:
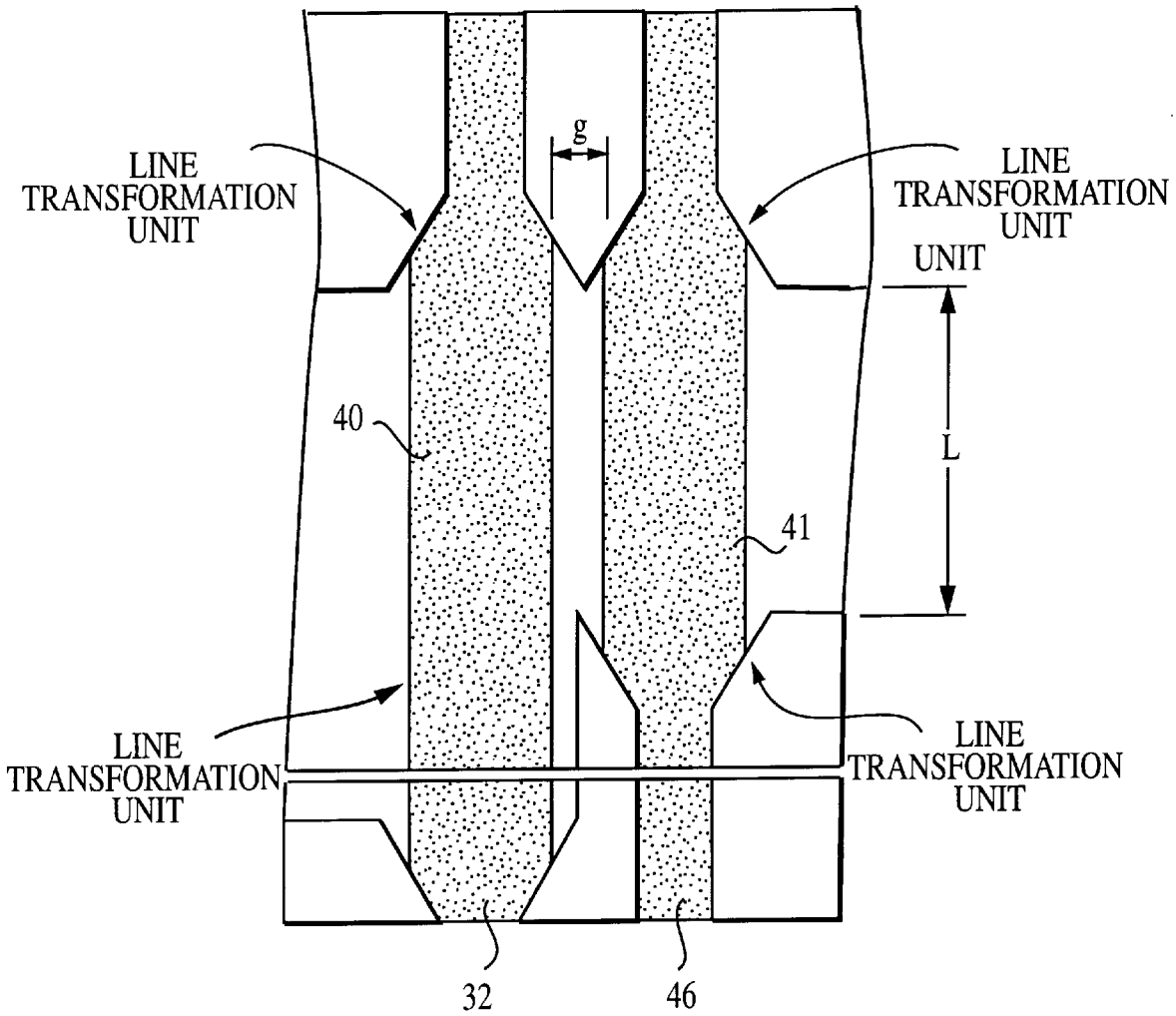
FIG. 6 is a view showing a configuration of a coupler part.

FIG. 6 is a view showing a configuration of the coupler part shown in FIG. 4, and is a plane view in a state that the upper conductor plate is removed. As shown in the figure, the coupler is configured by coupling two lines in the parts at where a space g between the dielectric strips 40, 41 by the normal NRD guide is drawn closer over the length L. On an input side or an output side of this coupler, the line transformation units are provided, respectively, so as to transform to the hyper NRD guide. When designing a 3 dB coupler with 60 GHz band, it becomes that L=12.8 mm, and g=1.0 mm. Also, when letting g=0.5 mm, then it becomes that L=7.7 mm. As shown in FIGS. 16A and 16B, when placing the dielectric strips as being spaced with the same distance, a much stronger coupling can be obtained in the normal NRD guide, as comparing to the hyper NRD guide, thus a variation of the coupling strength for a variation of the distance becomes smooth, thereby the dimensional accuracy required for the space g between the dielectric strips shown in FIG. 6 becomes lower.

Figure 7:
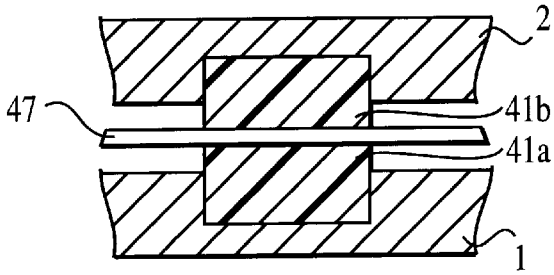
FIG. 7 is a view showing a cross-sectional structure of a hyper NRD guide in a mixer part.

FIG. 7 is a cross-sectional view showing a configuration of the mixer part shown in FIG. 4. In the figure, 47 indicates a substrate made of a dielectric, and is placed in alignment of sandwiching this substrate 47 with the dielectric strips 41*b*, 41*a* that are divided into two as an upper and a lower, between the upper and lower conductor plates 2, 1. The depths of the grooves that are provided in the upper and lower conductor plates 2, 1, the height dimensions of the dielectric strips 41*a*, 41*b*, the thickness dimension of the substrate 47, and the relative permittivities of the dielectric strips 41*a*, 41*b* aid of the substrate 47 are defined in such a manner that the cut-off frequencies of the LSM01 mode in the dielectric strips 41*a*, 41*b* and in the part being sandwiched by both of them in the substrate part become lower than the cut-off frequency of the LSE01 mode, and only LSM01 mode propagates with a usage frequency.

Figure 8:
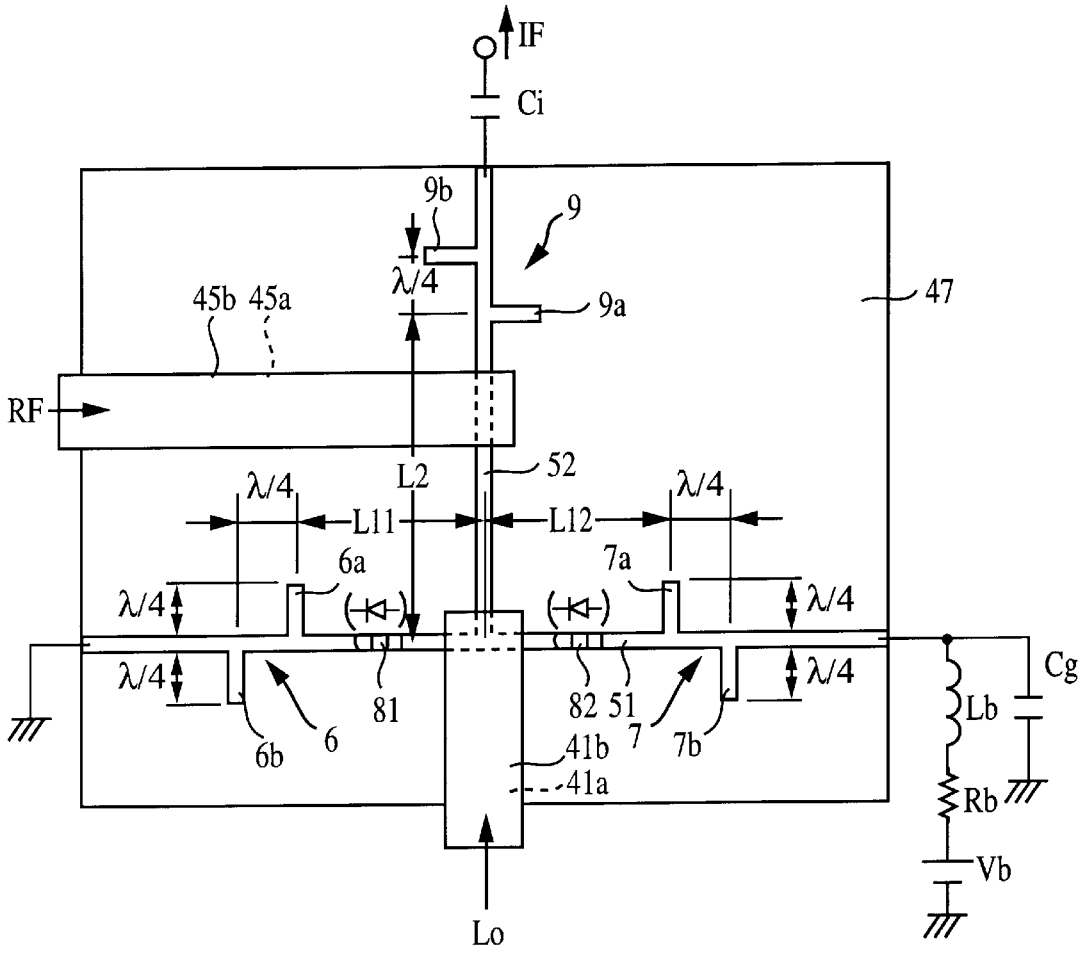
FIG. 8 is a plane view showing a configuration of a mixer part.

FIG. 8 is a plane view in a state that the upper conductor plate in the above mentioned mixer part is removed. 6*a*, 6*b*, 7*a*, 7*b*, 9*a*, and 9*b* indicate, respectively, an open stub with an approximately λ/4, and a space between 6*a*–6*b*, a space between 7*a*–7*b* and a space between 9*a*–9*b* is respectively set as an approximately λ/4. The part in which the open stub of λ/4 is provided with a space of λ/4 apart acts as a band ejection filer (BEF) that ejects a frequency signal with a wavelength λ. Further, by respectively setting the electrical lengths of the spaces L11, L12 from the center of the filter circuits 6, 7 to both filter circuits, as an integer multiplicity of an approximately ½ wavelength in the frequency of the millimeter wave that propagates on the dielectric strips 41*a*, 41*b*, this part (a suspended line between the filter circuits 6–7) acts as a resonant circuit with both ends thereof being shorted. Further, the electrical length of the space L2 from the center of the filter circuits 6, 7 to the open stub 9*a* is set in a relation as being an integer multiplicity of an approximately ½ wavelength in the frequency of the millimeter wave that propagates on the dielectric strips 45*a*, 45*b*. Since the electrical lengths of the above mentioned L11, L12 are approximately ½ wavelength, the center of the filter circuits 6, 7 is shorted equivalently. Therefore, this part (the suspended line between the central location of the filter circuits 6–7 and the filter 9) also acts as a resonant circuit with both ends being shorted. Further, since two Schottky barrier diodes 81, 82 are mounted in series for the conductor pattern 51, in the resonant circuit by the conductor pattern 51 and the filter circuits 6, 7, the NRD guide with the dielectric strips 41*a*, 41*b* and the diodes 81, 82 are matched, and a Lo signal that propagates on the dielectric strips 41*a*, 41*b* is transformed to a mode of the suspended line, and turns to be applied to the diodes 81, 82. On one hand, since the resonant circuit by the conductor pattern 52 is magnetic fieldly coupled with the NRD guide constituted of the dielectric strips 45*a*, 45*b* and the upper and lower conductor plates, with a RF signal being input from this NRD guide, that signal is transformed to the mode of the suspended line, thereby being applied to two diodes 81, 82 in the reversed phases. To the conductor pattern 51, the bias voltage supply circuits indicated by Lb, Rb, and Vb are connected, and the end part of this conductor pattern 51 is high frequencially grounded with a capacitor Cg. With this structure, the frequency components of difference between the RF signal and the Lo signal are combined in phase, and is extracted as an IF signal through a capacitor Ci. Further, the NRD guide by the above mentioned dielectric strips 41*a*, 41*b* does not transmit the LSE01 mode, but transmits a single mode of the LSM01, so that this NDR guide and the suspended line by the conductor pattern 52 are never coupled in the LSE01 mode.

A configuration of the circular part in the component 102 shown in FIG. 4 is almost the same as the isolator in the component 101, and is constituted of a dielectric strip 40 that is continuous from the coupler part, a dielectric strip 45 that is continuous from the mixer part, another dielectric strip 44, a ferrite resonator 43 and a magnet as being not shown.

Figure 9:
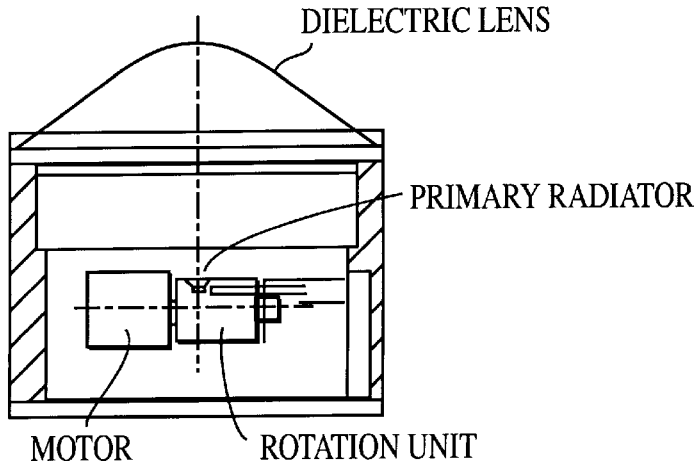
FIG. 9 is a cross-sectional view showing a whole structure of the millimeter wave radar module.

FIG. 9 is a view showing an alignment of the dielectric lens and the rotation unit shown in FIG. 4, and shows a vertical cross-sectional view of a whole millimeter radar module. FIG. 10 is a perspective view showing a configuration of the above mentioned rotation unit.

In this example, the normal NRD guide is configured by placing the dielectric strips between the respective side planes of the metal block 14 in a regular pentagon shape and the conductor plates that are in parallel therewith. Further, providing a dielectric resonator between the respective side planes of the metal block 14 and the conductor plates that are in parallel therewith configures a primary radiator. A position of this dielectric resonator is respectively provided in displaced positions in a direction of a rotational axis of the rotation unit, and as the motor rotates the rotation unit it is configured that the position of the primary radiator at the focal position of the dielectric lens switches sequentially in a direction parallel to the rotational axis.

FIG. 11A & 11B are views showing the configurations of one of the dielectric lines and the primary radiator of the rotational unit, FIG. 11A is a top view, and FIG. 11B is a cross-sectional view. Here, 61 indicates a dielectric resonator of the HE111 mode in a cylindrical shape, and is provided at a place where it is apart from the end part of the dielectric strip 60 with a predetermined distance. A window unit that is opened in a conical shape is provided in one part of the conductor plate 5, so that a radiation and an incidence of the electromagnetic waves are to be made from the upper part in the figure of this dielectric resonator 61. Providing a slit plate 62 between the dielectric resonator 61 and the conductor plate 5, a radiation pattern is controlled by a slit 63 of this slit plate 62.

Figure 12:
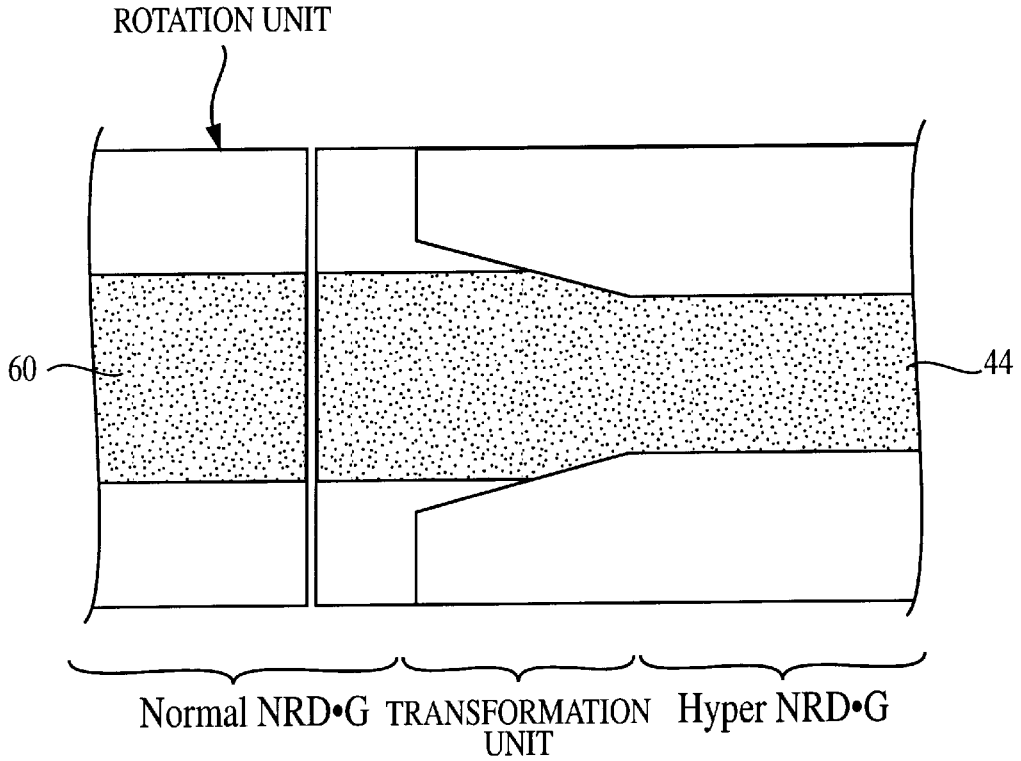
FIG. 12 is a view showing the structures of the connection units of the respective NRD guides on the rotational unit side and on the circuit unit side.

FIG. 12 is a view respectively showing the structures of the connection units of the NRD guides on the above-mentioned rotation unit side and on the circuit part side. Such as this, the NRD guides on the rotation unit side and the NRD guide in the part that selectively connects to these are set to be as the normal NRD guide, and a hyper NRD guide, and a line transformation unit of the hyper NRD guide and the normal NRD guide are provided on the circuit side.

Figure 13:
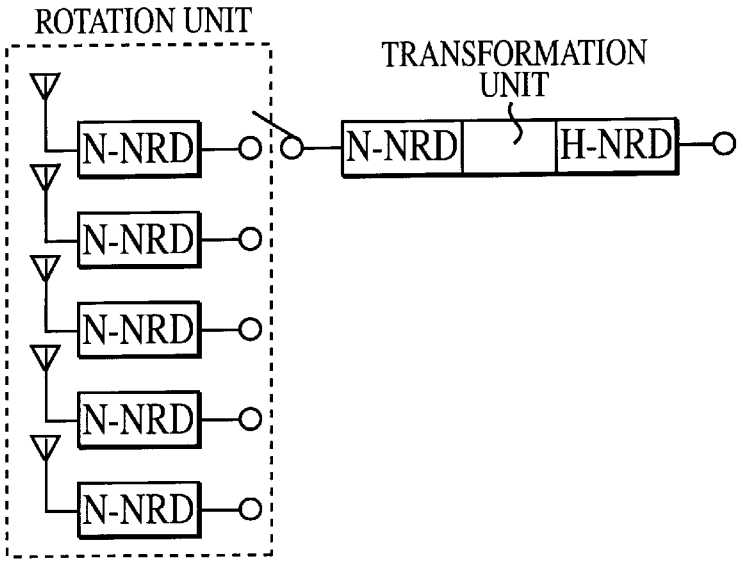
FIG. 13 is an equivalent circuit diagram of the rotational unit in the radar module.

FIG. 13 is an equivalent circuit diagram of the above-mentioned rotation unit part. As such, a gap between the rotation unit 103 shown in FIG. 4 and the component 102 acts as a dielectric line switch, and by providing a plurality of dielectric lines and a primary radiator in the rotation unit and then by rotating, switching the primary radiator sequentially, aid by varying a relative position for the dielectric lens, a directivity of a beam is varied sequentially.

Figure 17A:
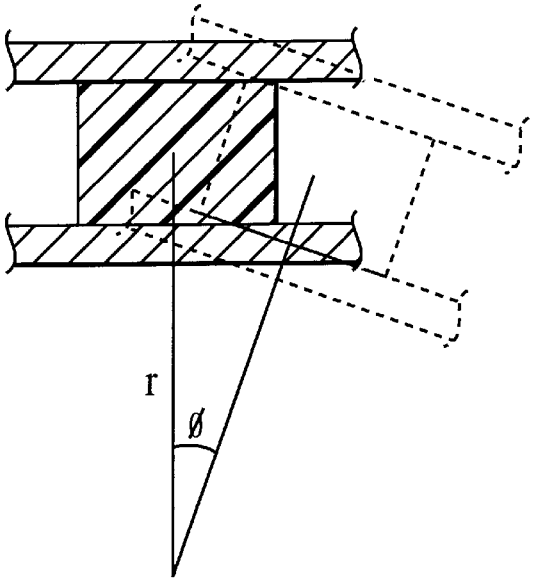
FIG. 17A to 17C are diagrams showing the examples of characteristics variations according to the switch operations in the normal NRD guide and in the hyper NRD guide.
Figure 17B:
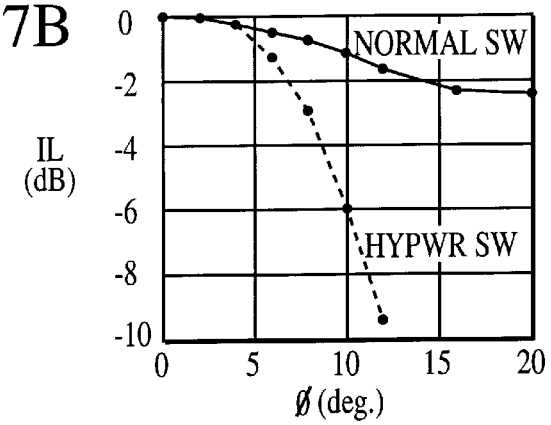
Figure 17C:
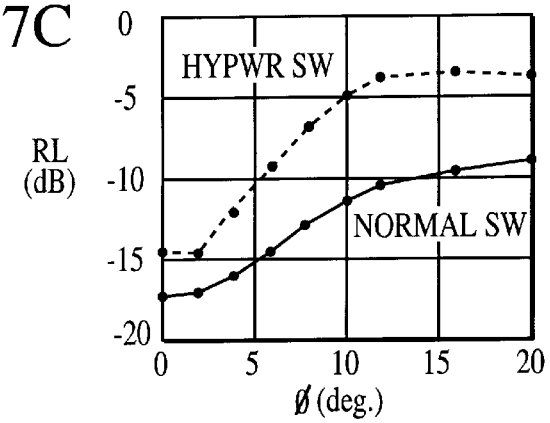

Here, the characteristics examples of the dielectric line switch according to the hyper NRD guide and of the dielectric line switch according to the normal NRD guide are shown in FIGS. 17A to 17C. FIG. 17A in the figure is a view showing a rotational alignment of one of the NRD guides and the other one of the NRD guides, for the dielectric line switch according to the normal NRD guides. Further, FIG. 17B is a view showing the insert on loss characteristics of the dielectric line switch according to the hyper NRD guide and of the dielectric line switch according to the normal NRD guide, and FIG. 17C is a view showing the reflection characteristics of both the dielectric line switches described above. In this example, there are shown the cases that he dimensions of the hyper NRD guide are set to be as a1=2.2 mm, b1=1.8 mm, g=0.5 mm in FIG. 1, and the dimensions of the normal NRD guide are set to be as a2=2.2 mm, b2=3.0 mm in FIG. 2, and the rotational radius r is set to be 6.1 mm. As such, the insertion loss in the same rotational angle is less and the reflection is also less in the normal NRD guide than the hyper NRD guide, thereby making it possible to implement a switching, while maintaining a connection state over wider rotational angles.

Figure 14:
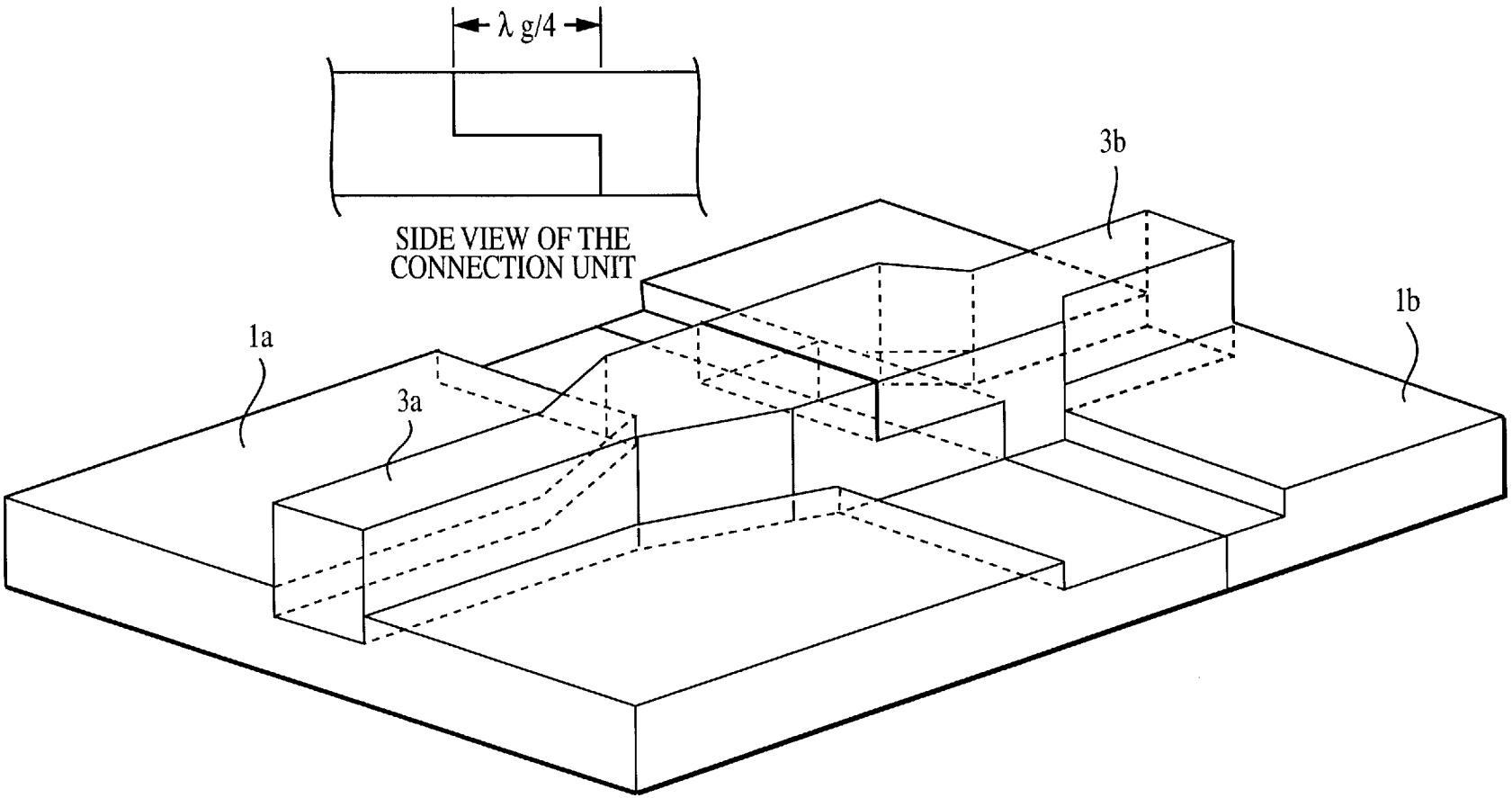
FIG. 14 is a partial perspective view showing a configuration of the connection unit between the components.
Figure 15:
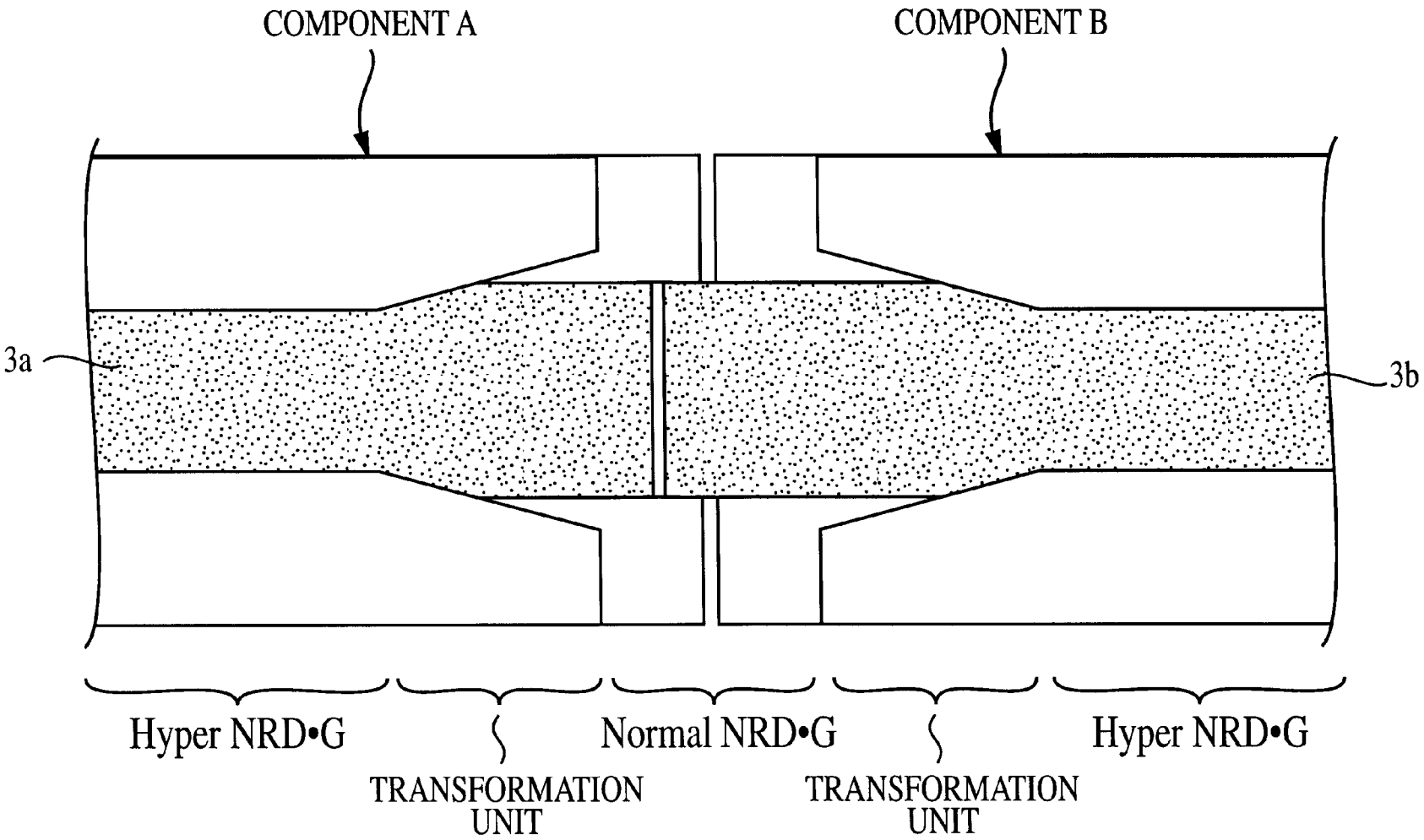
FIG. 15 is a view showing a configuration of the connection unit between the components.

FIG. 14 is a perspective view showing a structure of the connection unit of the NRD guides in-between two components according to the second embodiment, FIG. 15 is a plane view of the same connection unit. In either case, it is shown in a state that the upper conductor plate is removed. In the first embodiment, an example of two dielectric strips having been faced at the single connection plane, but as shown in FIGS. 14 and 15, by providing the connection planes of the dielectric strips at two places, and the distance of the connection planes is set to be an odd number multiplicity of a quarter (¼) of the in-tube wavelength in the frequencies to be used. With this structure, even though a gap occurred in the connection planes according to a temperature change would vary, it becomes that the reflected waves respectively generated at two planes are combined in the reversed phase, the transmission characteristics will not deteriorate regardless the temperature change. Further, since the transmission characteristics will not deteriorate even though the dimensions of the dielectric strips 3*a*, 3*b* in the length direction are more or less short, the dimensional tolerance of the dielectric strips can be relaxed. Then, the transmission characteristics will not be deteriorated even though there is a gap more or less in the upper and lower conductor plates since the connection unit is the normal NRD guide. As a result, the dimensional tolerance can be relaxed for the conductor plates, thereby the required accuracy in the assembly of the components will be lowered.

In the present invention, using the respective non radiative dielectric lines to the places suitable for the respective characteristics of the first type of the non radiative dielectric line (the normal NRD guide) and the second type of the non radiative dielectric line (the hyper NRD guide), a non radiative dielectric line part miniaturized as a whole and having an excellent characteristics is obtained.

In the present invention, the dielectric resonator can be strongly coupled to the non radiative dielectric line, and the manufacturing may be facilitated since the positional accuracy of the non radiative dielectric line and the dielectric resonator is not required so highly.

In the present invention, a propagation of its LSE01 mode can be prevented without using the LSE01 mode suppresser in the multipointed circulator, and as a result a reduction of the number of parts can be made, thereby no translation loss is generated by the mode transformation of the LSM01 mode and the LSE01 mode.

In the present invention, the non radiative dielectric lines can be strongly coupled in a short distance, thereby the coupler can be miniaturized.

In the present invention, since the coupling with its LSE01 mode can be prevented, without using the LSE01 mode suppresser in the mixer, the number of parts can be reduced.

In the present invention, a degradation of the transmission characteristics caused by a change of the facing alignment of the non radiative dielectric lines is small, thereby the excellent characteristics can be obtained in the insertion loss and the reflection characteristics.

In the present invention, the problems of the degradation of the characteristics and the unevenness caused by the positional displacement in the connection unit of the non radiative dielectric line parts can be resolved.

In the present invention, the integrated circuit in which the respective characteristics of the first type of the non radiative dielectric line and the second type of the non radiative dielectric line are utilized is obtained.

The non radiative dielectric line part of the present invention, providing a dielectric strip between two conductive planes in approximately parallel, using a non radiative dielectric line with an area of the dielectric strip as a propagation area of an electromagnetic wave and with an area other than the area of the dielectric strip as a non-propagation area, includes a first type of non radiative dielectric line in which a space between the conductive planes is made to be approximately equal to a height of the dielectric strip; and a second type of non radiative dielectric line in which the space between the conductive planes in said non-propagation area is made smaller than a space of the conductive planes in the propagation area, in which a cut-off frequency of a LSM01 mode that propagates in the propagation area is lower than a cut-off frequency of a LSE01 mode, and in which only LSM01 mode propagates with a usage frequency.

With this configuration, by using the respective non radiative dielectric lines to the places suitable for the respective characteristics of the first type of the non radiative dielectric line (the normal NRD guide) and the second type of the non radiative dielectric line (the hyper NRD guide), a non radiative dielectric line part miniaturized as a whole and having an excellent characteristics is obtained.

In the non radiative dielectric line part of the present invention, the first type of non radiative dielectric line is provided in a part that couples to a dielectric resonator. As a result, the dielectric resonator can be strongly coupled to the non radiative dielectric line, and the manufacturing may be facilitated since the positional accuracy of the non radiative dielectric line and the dielectric resonator is not required so highly.

In the non radiative dielectric line part of the present invention, the second type of non radiative dielectric line is used for a transmission line of a multipointed circulator. When configuring the multipointed circulator, the end parts of the dielectric line are placed so as to face to the parts of ferrite resonator from different directions (usually, three directions each separating from each other with 120 degrees), and thus even if a propagation mode to be used is the LSM01 mode, it has a tendency to transform to the LSE01 mode as a direction of the dielectric strip changes, at a time when being outputted from one port to other port, but by using the second type of the non radiative dielectric line as a dielectric line, so that a propagation of its LSE01 mode can be prevented without using the LSE01 mode suppresser.

Further, when connecting the dielectric line in which several dielectric lines are placed in parallel, to the multipointed circulator, the bend part is inevitably generated in the dielectric line part that is input/output for the respective ports of the circulator, by setting this part to be as the second type of non radiative dielectric line continuous from tie circulator, no translation loss is generated by the mode transformation of the LSM01 mode and the LSE01 mode in the bend part.

In the non radiative dielectric line part of the present invention, by drawing the first type of non radiative dielectric lines closer, a coupler that couples them each other is formed. As a result, the non radiative dielectric lines can be strongly coupled in a short distance, thereby the coupler can be miniaturized.

The non radiative dielectric line part in the present invention forms a mixer by placing two of the second type of non radiative dielectric lines in alignment with an approximately at right angle. For the case of the mixer in which two non radiative dielectric lines are placed in alignment with an approximately at right angle, a conductor pattern that couples to one of the dielectric strips is provided along with a direct on of a length of the other one of the dielectric strips, so that it tends to couple with the LSE01 mode in that part, but as a result of using the second type of nor radiative dielectric line as a non radiative dielectric line thereof, there is no propagation of the LSE01 mode, thereby it is not necessary to provide the dielectric strip with the mode suppresser of the LSE01 mode.

The non radiative dielectric line part of the present invention provides the non radiative dielectric line switch that switches a propagation/non propagation of an electromagnetic wave on a line by varying a facing alignment of two of said first type of non radiative dielectric lines is provided. By varying the facing alignment of the non radiative dielectric lines as such, the propagation/non propagation of the electromagnetic wave on the dielectric line can be switched, but since in the first type of the non radiative dielectric line, no electric current flow on a conductor surface in the propagation direction of the electromagnetic wave, so that a degradation of the transmission characteristics caused by a change of the facing alignment of the non radiative dielectric lines is small, thereby the excellent characteristics can be obtained in the insertion loss and the reflection characteristics.

The non radiative dielectric line part of the present invention provides the first type of non radiative dielectric line in a connection part with neighboring other non radiative dielectric line part. As a result, in the connection part of the non radiative dielectric line parts, as similar to the case in the above mentioned dielectric line switch, the problems of the degradation of the characteristics and the unevenness caused by the positional displacement can be resolved.

Combining the non radiative dielectric line parts constitutes the non radiative dielectric line integrated circuit of the present invention. With this configuration, the integrated circuit in which the respective characteristics of the first type of the non radiative dielectric line and the second type of the non radiative dielectric line are utilized, is to be obtained.

What is claimed is:

1. A non-radiative dielectric line assembly, comprising:

a first non-radiative dielectric line of a first type, comprising a dielectric strip between two approximately parallel conductive planes, in which a space between said conductive planes is approximately equal to a height of said dielectric strip; and a non-radiative dielectric line of a second type, comprising a dielectric strip between two approximately parallel conductive planes, in each said non-radiative dielectric line, an area defined by said dielectric strip being a propagation area for an electromagnetic wave, and an area other than said area defined by said dielectric strip being a non-propagation area, in said non-radiative dielectric line of said second type, said space between said conductive planes in said non-propagation area being smaller than said space between said conductive planes in said propagation area, and a cut-off frequency of an LSM01 mode that propagates in the propagation area being lower than a cut-off frequency of an LSE01 mode, whereby only said LSM01 mode propagates, said first dielectric line of said first type being electromagnetically coupled to said dielectric line of said second type; and further comprising a second dielectric line of said first type, said first and second dielectric lines of said first type defining a non-radiative dielectric line switch that switches between propagation and non-propagation of said electromagnetic wave by varying a facing alignment of said first and second non-radiative dielectric lines of said first type.

2. A non-radiative dielectric line assembly according to claim 1, wherein said respective dielectric strip of said first dielectric line of said first type is directly connected to said respective dielectric strip of said dielectric line of said second type.

3. A non-radiative dielectric line assembly, comprising:

a first non-radiative dielectric line of a first type, comprising a dielectric strip between two approximately parallel conductive planes, in which a space between said conductive planes is approximately equal to a height of said dielectric strip; and a non-radiative dielectric line of a second type, comprising a dielectric strip between two approximately parallel conductive planes, in each said non-radiative dielectric line, an area defined by said dielectric strip being a propagation area for an electromagnetic wave, and an area other than said area defined by said dielectric strip being a non-propagation area, in said non-radiative dielectric line of said second type, said space between said conductive planes in said non-propagation area being smaller than said space between said conductive planes in said propagation area, and a cut-off frequency of an LSM01 mode that propagates in the propagation area being lower than a cut-off frequency of an LSE01 mode, whereby only said LSM01 mode propagates;

said first dielectric line of said first type being electromagnetically coupled to said dielectric line of said second type; and further comprising a second dielectric line of said first type, said first and second dielectric lines of said first type being formed on separate respective dielectric substrates, said first non-radiative dielectric line of said first type forming a connection part with said second non-radiative dielectric line of said first type by electromagnetic coupling between said first and second dielectric lines.

4. A non-radiative dielectric line assembly according to claim 3, wherein said respective dielectric strip of said first dielectric line of said first type is directly connected to said respective dielectric strip of said dielectric line of said second type.

* * * * *